United States Patent [19]

Eash

[11] Patent Number: 4,708,033

[45] Date of Patent: Nov. 24, 1987

[54] STOPPER REMOVER

[76] Inventor: Lester E. Eash, 7134 S. Marina Pacifica, Long Beach, Calif. 90803

[21] Appl. No.: 615,170

[22] Filed: May 30, 1984

[51] Int. Cl.[4] ..... B67B 7/32

[52] U.S. Cl. ..... 81/3.37; 81/3.41; 81/3.44

[58] Field of Search ..... 81/3.34, 3.36, 3.37, 81/3.4, 3.41, 3.44, 3.46 R, 3.3 R, 3.31, 3.33, 3.38 R

[56] References Cited

U.S. PATENT DOCUMENTS

| | | | |
|---|---|---|---|
| 110,127 | 12/1870 | Fetter . | |
| 111,207 | 1/1871 | Henkle . | |
| 538,279 | 4/1895 | Poggenburg . | |
| 557,546 | 4/1896 | Blevney . | |
| 1,091,301 | 3/1914 | Doheny | 81/3.3 R |
| 1,492,908 | 5/1924 | Trumbo . | |
| 1,728,418 | 9/1929 | Litchfield . | |
| 1,787,018 | 12/1930 | Porz . | |
| 2,335,777 | 11/1943 | Marcellus | 81/3.37 |
| 2,484,043 | 10/1949 | Malen | 81/3.41 |
| 2,554,898 | 5/1951 | Clark | 81/3.2 |
| 2,589,051 | 3/1952 | Carter | 81/3.46 |
| 2,612,065 | 9/1952 | Packer et al. | 81/3.2 |
| 2,746,323 | 5/1956 | Johnson | 81/3.1 |
| 3,722,327 | 3/1973 | Strassel | 81/3.36 |
| 3,800,345 | 4/1974 | Feliz | 7/14.6 |
| 4,052,917 | 10/1977 | Gee | 81/3.42 |
| 4,422,355 | 12/1983 | Burns | 81/3.31 |
| 4,458,564 | 7/1984 | Simmons | 81/426 |

*Primary Examiner*—James L. Jones, Jr.

*Attorney, Agent, or Firm*—Fulwider, Patton, Rieber, Lee & Utecht

[57] ABSTRACT

A tool for removing headed stoppers from bottles such as champagne bottles, includes a base having a two fingered yoke and a side support, sized and shaped to engage the upper lip and the side of the neck of the bottle respectively, so that when a handle, pivotally attached to the base, is lowered toward the bottle, a pair of inwardly biased jaws slide down over the head of the stopper to engage its undersurface between the fingers of the yoke. Thereafter, the handle is lifted extracting the stopper while inwardly facing extensions positioned above the stopper on the jaws restrict upward motion of the stopper to prevent uncontrolled motion thereof.

18 Claims, 7 Drawing Figures

STOPPER REMOVER

BACKGROUND OF THE INVENTION

Sparkling wines and champagnes are traditionally provided in a bottle having a plastic or cork stopper which, in addition to being safety wired, is retained by a friction fit within the mouth of the bottle. Such secure retention means must be provided to prevent pressurized gas within the bottle from pushing the stopper out. Although at festive occasions it is sometimes desired to "pop" the stopper by gripping the bottle and slowly working the stopper out using ones thumbs so that it flies upwardly, such presents the danger of a flying stopper in commercial establishments and is unwise in a crowded gathering. The flying stopper may also damage the ceiling. Therefore, towels commonly are wrapped around the bottle to dampen the stopper's flight. The towel is disadvantageous because it makes the stopper removal clumsy and silences the festive "pop". With or without a towel, stoppers sometimes generate much more retention friction than is desirable and ultimately are very difficult to remove. This is especially troublesome in commercial establishments where many bottles must be opened in a short time. There are also times when a bottle has been agitated and the friction forces between stopper and the bottle are insufficient to overcome the now highly pressurized gas so that the stopper flies free as the safety wire is removed. This dangerous and unexpected result can occur when the bottle is facing an eye or other easily damaged article. Therefore, a simple, economical, safe, and easy to operate stopper remover which can prevent flight of the stopper under all conditions has been needed.

BRIEF DESCRIPTION OF THE PRESENT INVENTION

The present tool provides easy and safe removal of stoppers from champagne, sparkling wines and the like. It is comprised of a base member, having a two-fingered yoke which extends sidewardly therefrom for engagement with the top lip of the bottle to be opened, as well as a lower extension which is shaped to engage the side of the bottle's neck so that the yoke remains positioned in the desired lateral location. A lever is pivotally mounted to the base above the yoke to extend over the stopper to the opposite side of the bottle to provide an opener handle. When the body has been fitted to a bottle, the handle is lowered causing a pair of inwardly biased jaws members to spread out over the stopper and then snap towards each other to wedge jaws between the bottle lips and the stopper head and engage an upwardly facing abutment surface on each jaw with the underside of the stopper head. Since the jaws normally extend less than 90°, the safety wires, which normally extend over the top of the stopper every 90°, can be removed. If the stopper is not pushed out of the bottle by the pressurized gas therewithin, the handle is then raised with respect to the bottle levering out the stopper with a mechanical advantage dependent upon the length of the components. A pair of blocker members are included above the abutment surfaces of the jaws. The blocker members include facing abutment surfaces to keep the jaws spaced enough to slip over the stopper head. The blocker members are spaced a distance from the yoke to allow the jaws to engage any normally sized stopper head and yet restrict upward motion of the stopper once the safety wires have been removes or it has been pulled out of the bottle neck to a location where pressurized gas within the bottle energizes the stopper upwardly.

Therefore it is an object of the present invention to provide a tool for quickly removing stoppers from sparkling wine and champagne bottles by a person of minimal strength.

Another object is to provide a champagne stopper remover which can be constructed relatively economically and yet is sturdy and longlasting.

Another object is to provide a tool for removing stoppers from champagne bottles which prevents dangerous unrestricted flight of the stopper without reducing the festive "pop" normally associated therewith.

Another object is to provide a tool for removing stoppers from champagne bottles which eliminates surprise stopper flight when the safety wires are removed.

These and other objects and advantages of the present invention will become apparent to those skilled in the art after considering the following detailed Specification together with the accompanying drawings wherein:

DETAILED DESCRIPTION OF THE PREFERRED EMBODIMENT

Figure 1:
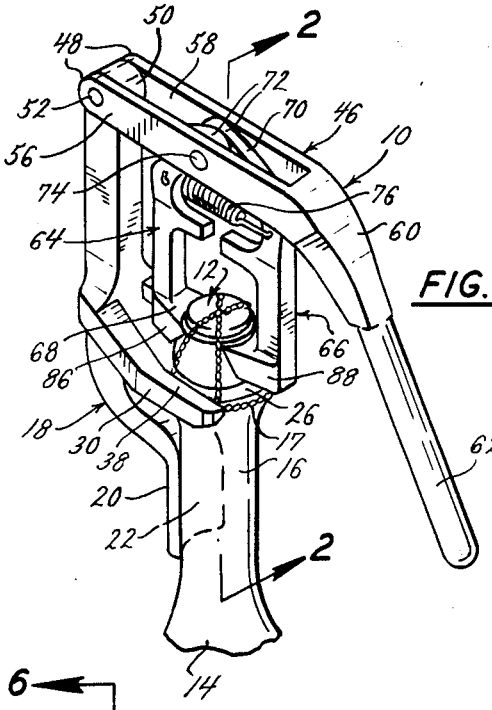
FIG. 1 is a perspective view of a stopper removal tool constructed according to the present invention.
Figure 2:
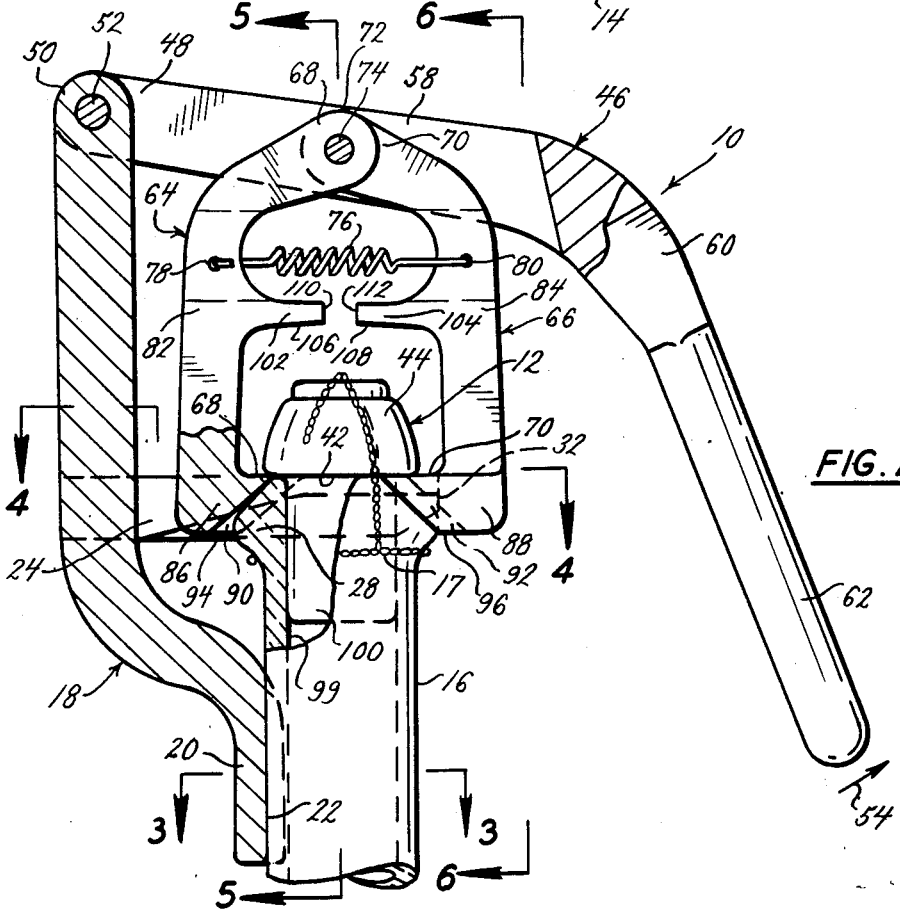
FIG. 2 is a partial cross-sectional plan view of the tool of FIG. 1 taken on line 2—2 thereof.
Figure 3:
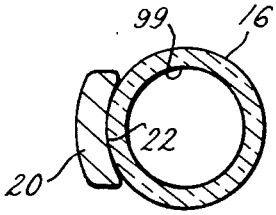
FIG. 3 is a cross-sectional view taken at line 3—3 of FIG. 2.

Referring to the drawings more particularly by reference numbers, number 10 in FIGS. 1 and 2 refers to a tool for removing a stopper 12 from a champagne, sparkling wine or other pressurized bottle 14 whose neck 16 and safety wires 17 only are shown. The tool 10 includes a frame 18 which has a lower pad 20 with a concave inner abutment surface 22 (FIG. 3) adapted for engagement with the lateral periphery of the neck 16 of the bottle 14 and a laterally extending yoke 24 (FIG. 4) for engagement with the upwardly and inwardly inclined surface 26 of the lip 28 of the bottle 14.

Figure 5:
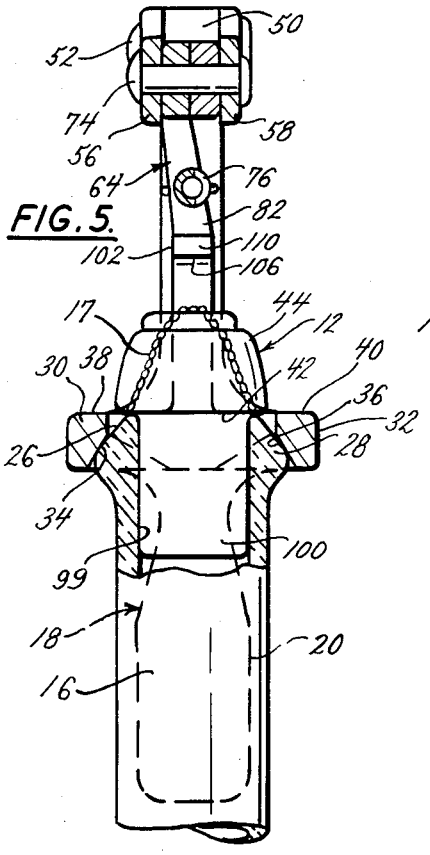
FIG. 5 is a cross-sectional view taken at line 5—5 of FIG. 2.
Figure 4:
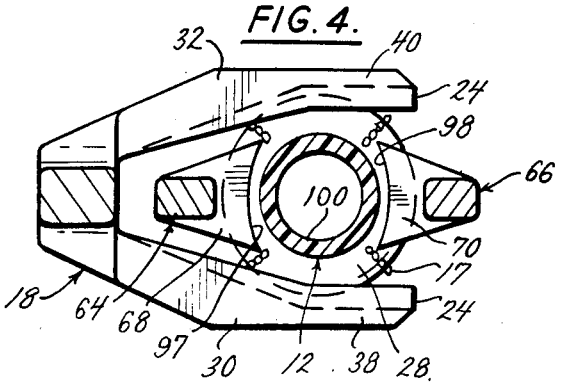
FIG. 4 is a top cross-sectional view taken at line 4—4 of FIG. 2.
Figure 6:
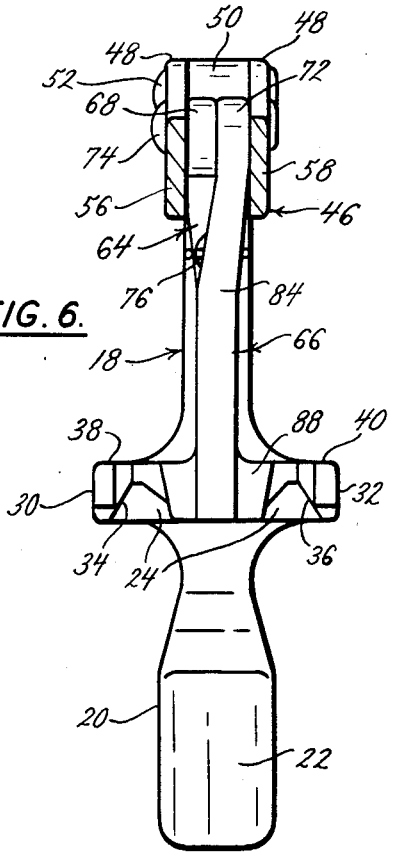
FIG. 6 is a front cross-sectional view taken at line 6—6 of FIG. 2.

The yoke 24 is cast integral with the frame 16 and extends laterally thereform in the form of two generally parallel fingers 30 and 32 (FIG. 4). As shown in FIGS. 5 and 6, the fingers 30 and 32 are each formed on their insides with respective downwardly and inwardly facing oppositely disposed chamfered abutment surfaces 34 and 36 respectively which are oriented to generally complement the angle of the upwardly facing surface 26 of the bottle lip 28. As depicted in broken lines in FIG. 4, the abutment surfaces diverge outwardly away from one another as they extend from the axial frame member 18 to accommodate bottle necks having a range of different diameters and then at their most divergent point bend to project parallel to one another. When the tool 10 is to be used, the bottle 14 is oriented so that the safety wires 17 extend diagonally across the stopper 12 and the fingers 30 and 32 of the yoke 24 are slid sidewardly toward the bottle 14 until the oppositely disposed abutment surfaces 34 and 36 are engaged with the upwardly facing surface 26 of the lip 24.

The upper surfaces 38 and 40 of the yoke fingers 30 and 32 respectively are simultaneously aligned with or below the radial flange 42 formed on the underside of the head 44 of the stopper 12 while the concave abutment surface 22 of the pad 18 is brought into contact with the side of the bottle neck 16. This is generally the position shown in FIG. 1. As can be seen in FIG. 1, the fingers 30 and 32 of the yoke 24 extend longitudinally beyond their tangential contact points with the upper lip surface 26 and are slightly canted away from each other. This allows the yoke 10 to be placed or wedged onto bottles 14 having different diameter lips 28 while remaining clear of the safety wires 17 to permit free access thereto for removal.

An elongated lever handle 46 is connected at one end 48 to the upper end 50 of the frame by means of a pivot pin 52 to allow rotative movement as shown by the arrow 54 (FIG. 2). The end 48 of the lever 46 is itself a bifurcated clevis forming a pair of laterally spaced apart parallel fingers 56 and 58 which extend from the pivot pin 52, laterally over the stopper 12 (FIG. 1) to a downturned intermediate portion 60 which is connected with a hand grasp handle portion 62.

Figure 7:
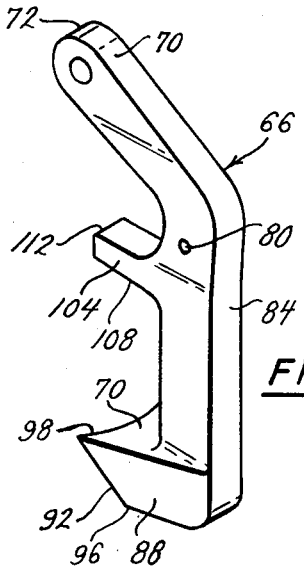
FIG. 7 is a perspective view of a jaw member used in the tool of FIGS. 1 through 6.

A pair of outwardly and downwardly extending jaw members 64 and 66 are disposed in the same plane as the lever 46 and are suspended centrally from the bifurcated handle fingers 56 and 58 by means of a common pivot pin 74 (FIGS. 1 and 2). The jaw members 64 and 66 are identical, each having a slightly laterally offset upper portion 68 and 70 (FIG. 1) which overlap and are connected generally at the central portion 72 of the fingers 56 and 58 by means of the pivot pin 74. The jaw pivot pin 74 is generally parallel to the handle pivot pin 52, the abutment surfaces 34 and 36 and the upper surfaces 68 and 70, and is positioned generally at right angles to the lever 46 and the base 18. The jaw members 64 and 66 are free to pivot but are biased together by a tension spring 76 which extends therebetween and is formed on its opposite ends with hooks which connect through transverse bores 78 and 80 (FIG. 7) formed in the central shank portion 82 and 84 of each jaw member 64 and 66. The jaw members 64 and 66 are formed on their lower extremities with inturned confronting jaws 86 and 88 respectively.

The jaws 86 and 88 are formed with respective downwardly and inwardly facing similar concave conical surfaces 90 and 92 which taper downwardly to meet with horizontal undersides 94 and 96 (FIG. 2). The conical surfaces 90 and 92 join at their upper ends with horizontal upper surfaces 68 and 70 to form semi-circular edges or teeth 97 and 98, respectively, each having a radius slightly larger than the radius of the stopper head 12 to assist in wedging between the head 12 and the lip 28. The arc subtended by a single jaw edge 97 and 98 preferably is less than 90° so that it can fit between adjacent safety wires 17.

Projecting laterally inwardly from the central portions 82 and 84 of the jaw members 64 and 66 are blocker fingers 102 and 104. Such fingers are formed with downwardly facing blocking surfaces 106 and 108, respectively, and terminate in respecting confronting ends 110 and 112 which are spaced apart a distance sufficient to engage one another and maintain the jaws 86 and 88 spaced a predetermined distance apart. Such spacing maintains the downwardly facing conical surfaces spaced apart a distance sufficient to cause such surfaces to engage the laterally opposite sides of the top of the stopper head 44 when the remover is being applied to the bottle such that lowering of such jaws on the stopper head will cause such jaws to be spread apart. Such spacing is also sufficient to accommodate closure of the jaws 86 and 88 toward one another to a sufficient degree during use to enable firm engagement thereof, beneath the flange 42 of the head 100. It will be noted that when the handle 62 is in the closed position shown in FIG. 2, the jaws 86 and 88 project into the plane of and are received between the fingers 30 and 32.

In operation, when it is desirable to remove a stopper 12 from a bottle neck 16, the user may grasp the frame 18, rotate the handle 62 counterclockwise as depicted by the directional arrow in FIG. 2 to raise the jaws 86 and 88. He or she may then manipulate the tines 38 and 40 of the yoke 24 into position on the opposite sides of the bottle lip 28 to engage the downwardly and inwardly facing abutments surfaces 34 and 36 with the upwardly and outwardly facing lip surface 26 (FIG. 5) to nest such yoke securely on the bottle lip while engaging the pad 22 (FIG. 2) with the lateral surface of the bottle neck 16. With the frame securely supported on the three point contact defined by engagement of such abutment surfaces 34 and 36 with the lip surface 26 and the pad surface 22 with the lateral surface of the neck 16, the frame 18 is supported securely in position and the handle 62 may then be lowered to pivot such handle clockwise about the handle pivot pin 52 (FIG. 2) to lower the jaw members 64 and 66.

Such lowering of the jaw members 64 and 66 will engage the downwardly and inwardly facing conical surfaces 90 and 92 with the diametrically opposite sides of the stopper head 44 (FIG. 2) thus causing continued downward travel thereof to urge the jaws 86 and 88 outwardly away from one another enabling such jaws to travel downwardly and outwardly about the opposite peripheral sides of such head 44. Such downward travel will be continued until the edges 96 and 98 register beneath the flange 42 formed at the bottom periphery of the head 44. At this point, the operator will feel a slight inward movement of the jaw member 64 and 66 toward one another as the jaws 86 and 88 shift slightly inwardly under the influence of the tension spring 76 (FIG. 2). The handle 62 may then be rotated upwardly and outwardly in a counterclockwise direction about the handle pivot pin 52. Downward shifting of the frame 18 will be resisted by support of the abutment surfaces 34 and 36 on the lip 28 (FIG. 5), as complemented by the supporting action of the pad against the bottle neck 16. The retaining wires 17 may then be severed or untwisted to release the stopper 12, while the user holds the remover firmly in position. In the event pressure has built up under the stopper 12 to a point which will cause abrupt release of the stopper, such stopper will be engaged against the under surfaces 106 and 108 of the block fingers 102 and 104 (FIG. 2) thus blocking such stopper erratic and uncontrolled release to be propelled about the room causing possible injury or discomfort to standersby.

Thereafter, continued upward movement of the handle 62 in the direction of the arrow 54 shown in FIG. 2 will exert an upward force under the flange 42 of the stopper head 44, which force will be resisted by engagement of the abutment surfaces 34 and 36 on the upwardly facing lip surface 26 (FIGS. 5 and 6). As upward movement of the handle 62 is continued the central disposition of the jaw pin 74 will tend to draw the jaw members 64 and 66 upwardly and inwardly thereby tending to draw the jaws 86 and 88 themselves inwardly and wedging the jaw edges 97 and 98 into the space between the stopper flange 42 and the lip 28. Such radial inwardly forces on the jaws 86 and 88 will positively engage such jaws under the stopper flange 42 such that continued upward shifting of the handle 62 will lift the stopper 12 to draw the stopper shank 100 upwardly relative to the bottle neck 16. As withdrawal of the stopper 12 is continued, a point will be reached wherein the frictional resistance to movement of the shank 100 within the neck 16 will be reduced to the point where the gaseous pressure built up within the bottle will overcome such frictional resistance thus tending to drive the stopper 12 from the bottle neck. Such forced ejection of the stopper 12 will be limited by engagement of the stop thereof with the downwardly facing blocker surfaces 106 and 108 to thus permit controlled escape of the pressurized gases to the point where the stopper 12 may be gently and controllably removed.

From the foregoing, it will be apparent that the stopper remover of the present invention provides a device which is relatively economical to manufacture and is sturdy in construction thus providing for long and trouble free life. The remover provides for positive control of the stopper during the removal procedure while being convenient to operate.

What is claimed is:

1. A tool for removing the stopper from a bottle including:

a frame member having:

a yoke portion extending sidewardly therefrom and formed with first and second fingers spaced apart a first predetermined distance;

a first pivot portion disposed above said yoke portion;

a support portion projecting below said yoke and including a pad facing in a direction similar to the direction said yoke extends and adapted to engage the bottle;

an elongated lever member having an elongated lever member formed with first and second ends, said first end being connected with said first pivot means and said second end being formed with a handle portion for application of manual force thereto;

a second pivot portion pivotally connected to said first pivot portion of said base member; and a first jaw member having:

a fourth pivot portion pivotally connected to said lever member; and a first jaw adapted for engagement with a stopper in a first direction;

a second jaw member having:

a fifth pivot portion pivotally connected to said lever member; and a second jaw adapted for engagement with a stopper in a second direction opposite to said first direction;

said first and second jaws being narrower than said first predetermined distance between said fingers so that said first and second jaws can fit therebetween; and bias means connected between said first and second jaw members to bias them toward each other.

2. The tool defined in claim 1 wherein said first jaw includes:

a first jaw upper surface for lifting engagement with the stopper; and a first jaw blocker member extending over said first jaw upper surface spaced a second predetermined distance therefrom, and wherein said second jaw includes:

a second jaw upper surface for lifting engagement with the stopper; and a second jaw blocker member extending over said second jaw upper surface spaced said second predetermined distance therefrom, whereby said blocker members prevent uncontrolled flight of the stopper when said first and second jaws are in engagement therewith.

3. The tool defined in claim 2 wherein said first jaw blocker member includes:

a first jaw blocker member abutment surface facing in said first direction, and wherein said second jaw blocker member includes:

a second jaw blocker member abutment surface facing in said second direction for engagement with said first jaw blocker member abutment surface to restrict pivoting movement of said first and second jaw members together and prevent contact of said first and second jaws under urging of said bias means.

4. The tool defined in claim 3 wherein said first jaw includes:

a first conical concave surface extending from and under said first jaw upper surface, wherein said second jaw includes:

a second conical concave surface extending from and under said second jaw upper surface, wherein said first finger includes:

a first chamfered surface facing downwardly and inwardly toward said second finger, and wherein said second finger includes:

a second chamfered surface facing downwardly and inwardly toward said first finger.

5. The tool defined in claim 4 wherein said base abutment surface is a concave base abutment surface.

6. The tool defined in claim 1 wherein said yoke includes:

first and second fingers spaced apart a first predetermined distance and extending generally parallel to said first and second directions, said first and second jaws being narrower than said first predetermined distance between said fingers so that said first and second jaws can fit therebetween.

7. The tool defined in claim 6 wherein said first jaw includes:

a first jaw upper surface for lifting engagement with the stopper; and a first jaw blocker member extending over said first jaw upper surface spaced a second predetermined distance therefrom, and wherein said second jaw includes:

a second jaw upper surface for lifting engagement with the stopper; and a second jaw blocker member extending over said second jaw upper surface spaced said second predetermined distance therefrom, whereby said blocker members prevent uncontrolled flight of the stopper when said first and second jaws are in engagement therewith.

8. A stopper remover for removing a stopper which projects partially from the neck of a bottle terminating in a lip having a maximum diameter of a selected distance and formed with exterior upwardly and outwardly facing peripheral surface, such remover being of the type including a frame for mounting on the bottle, elongated pivotal jaw members formed on their respective one ends with pivot ends and on the opposite ends with inturned confronting jaws for engagement with the opposite sides of the projecting portion of said stopper and, a lever arm pivotally mounted between said frame and jaws for rotation from a stopper engagement to a stopper removal position and including a handle projecting therefrom, the improvement comprising:

an elongated axial frame member formed on one end with a pad for engaging the side of a bottle neck and on its opposite end with a pivot end:

a pair of coextensive yoke fingers projecting laterally in one direction from said axial frame member, said fingers being formed with confronting inclined abutment surfaces, spaced apart less than said selected distance, and facing inwardly toward one another and in the direction of said pad for engagement with said upwardly and outwardly facing peripheral surface to cooperate with said pad in supporting said frame from said bottle;

said lever arm projecting laterally in said one direction from said frame and being pivotally connected on one end with said pivot end of said frame and pivotally connected intermediately with said pivot ends of said respective jaw members for rotation in one direction about said one end thereof toward said removal position to draw said jaws in a direction away from said yoke finger whereby said frame may be mounted on said bottle with said pad and abutment surfaces engaged therewith such that rotation of said lever toward said removal position will draw said jaws into engagement with the opposite sides of the projecting portion of said stopper and continued rotation toward said removal position will draw said stopper from the neck of said bottle.

9. A stopper remover as found in claim 8 wherein:

said jaw members are formed intermediately with laterally projecting blocker fingers overlying and spaced from said jaws for blocking uncontrolled egress of said stopper from said neck.

10. A stopper remover according to claim 8 wherein:

said jaw members and lever arm are configured such that when said lever arm is rotated in the direction from said removal position toward the stopper engagement position said jaw member will project into the plane of said yoke fingers, said jaw members being so configured and shaped as to be received between said yoke fingers.

11. A stopper remover according to claim 8 wherein:

said jaws are formed with respective outwardly concave, conical surfaces facing inwardly toward one another and in the direction of said pad.

12. A stopper remover according to claim 8 wherein:

said lever arm, in the stopper engagement position, projects laterally from said frame member to form an intermediate portion and said remover includes a common pivot pin connecting the respective one ends of said jaw members directly to said intermediate position.

13. A stopper remover according to claim 12 wherein:

said intermediate portion of said lever arm is bifurcated to form a clevis and said one ends of said jaw members are received in said clevis.

14. A stopper remover according to claim 8 wherein:

said jaw members lie in the same plane as said lever arm.

15. A stopper remover according to claim 8 wherein:

said pad is spaced axially from said jaws and said jaw members are sufficiently long to dispose said jaws in the plane of said yoke fingers when said lever arm is rotated to said stopper engagement position.

16. A stopper remover according to claim 8 wherein:

said jaw members project axially from said pivot ends and angle away from one another to cause the force applied thereto when said lever arm is rotated in said one direction to tend to draw said jaws toward one another.

17. A stopper remover according to claim 8 wherein:

said abutment surfaces project laterally from said axial frame member and diverge outwardly away from one another to accommodate bottle lips having a range of diameters.

18. A stopper remover for removing a stopper partially projecting from the neck of a bottle formed with a peripheral lip having a maximum diameter of a selected distance and comprising:

an elongated axial frame formed with first and second ends, the first end defining a pivot end;

a pair of coextensive, spaced apart yoke fingers projecting laterally in one direction from said first end of said frame member and formed with abutting surfaces inclined to angle inwardly toward one another and in the direction of said pivot end, said abutment surfaces being spaced apart a distance less than said selected distance;

a lever arm pivotally connected on one end with said pivot end and projecting laterally therefrom in said one direction, disposed centrally over said yoke fingers, and rotatable from a stopper engagement position to a stopper removal position; and a pair of elongated jaw members pivotally mounted on their respective one ends from said lever arm to be disposed centrally over said yoke fingers, projecting towards said yoke fingers, and formed at their free extremities with inturned confronting jaws for engaging the opposite sides of the projecting portion of said stopper, said jaw members being so configured and arranged as to be received between said yoke fingers when said lever arm is rotated to the stopper engagement position whereby said frame may be moved into position with said yoke fingers straddling the bottle neck to engage said abutment surface with the opposite sides of said lip and said lever arm rotated to its retracted position to engage said jaws on the opposite sides of said stopper and said lever arm then rotated towards said removal position to cause said yoke fingers to bear against said lip as said jaws are drawn in a direction away from said finger members to withdraw said stopper from said bottle neck.

* * * * *